US006089338A

United States Patent [19]

Bouligny, Jr.

[11] Patent Number: 6,089,338

[45] Date of Patent: Jul. 18, 2000

[54] FLUSH MOUNTED SELF ALIGNING SPIDER

[75] Inventor: Vernon J. Bouligny, Jr., New Iberia, La.

[73] Assignee: Frank's Casing Crew and Rental Tools, Inc., Lafayette, La.

[21] Appl. No.: 09/054,808

[22] Filed: Apr. 3, 1998

[51] Int. Cl.[7] ..... E21B 19/06

[52] U.S. Cl. ..... 175/423; 464/163; 188/67; 166/75.14; 166/77.52

[58] Field of Search ..... 166/88.2, 78.1, 166/75.14, 77.52; 175/423; 188/67; 464/163

[56] References Cited

U.S. PATENT DOCUMENTS 2,589,159 2/1952 Stone ..... 175/423 X 5,335,756 8/1994 Penisson .

5,848,647 12/1998 Webre et al. ..... 175/423 X

*Primary Examiner*—Eileen Dunn Lillis

*Assistant Examiner*—Sunil Singh

*Attorney, Agent, or Firm*—John D. Jeter

[57] ABSTRACT

A spider for use within the rotary table opening has all movable elements flush with or below the rig floor. The conventional wedge shaped slips are supported and aligned by a slip carrier that has a spherical outer surface that slideably mates with a spherical bowl inner surface in the spider such that the pipe, slip, and slip carrier can tilt as a unit about any horizontal axis that passes through the spherical surface center.

9 Claims, 3 Drawing Sheets

FLUSH MOUNTED SELF ALIGNING SPIDER

This invention has several features of our application Ser. No. 08/748,450 filed Nov. 13, 1996, issued Dec. 15, 1998 as U.S. Pat. No. 5,848,647. By reference herein that patent is made part of this application.

This invention pertains to a flush mounted pipe supporting spider and slip assembly for use in the recess of a rotary table, for manipulating pipe strings in a well bore. More particularly it relates to pipe gripping slips and slip carriers that are supported on spherical surfaces of the spider bowl. This enables the slips and slip carriers, as a unitary assembly, to pivot about any horizontal axis through the bowl surface center even when supporting a vertical pipe load.

BACKGROUND OF THE INVENTION

Traditional spiders contain a plurality of slips circumferentially surrounding the exterior of the pipe and are housed by what is commonly referred to as a "bowl". The bowl is regarded to be surfaces on the inner bore of the spider. Generally, the apparatus is engaged by placing it around a given section of pipe in the tubing string. The radial interior of the slips typically carry or form hard metal teeth for engaging the pipe. The exterior surface of the slips and the interior surface of the bowl usually have opposing engaging surfaces which are inclined and downwardly converging. In certain embodiments, the slips function like a wedge between the pipe surface and the bowl surface to provide a relationship between vertical and lateral slip movement. The greater the downward load imposed upon the slips by the pipe, the greater is the lateral force applied between slip and pipe at the pipe gripping surfaces. Further, when the pipe string is lifted by the rig hook and the pipe load is no longer on the slips, the slips are automatically free of surface loading forces and can readily move to clear the pipe surface. This process is referred to in the industry as a "self energizing" method of engaging the pipe for supporting the weight of the pipe string being suspended from the spider. The spider is supported by rig related structure.

During traditional well bore related operations, a spider which houses the slips, is located above the rotary table and is used for supporting the pipe suspended in the well by the bowl. In typical operations the spider remains stationary and the pipe is moved up or down by pipe gripping means supported by the rig hook. The hoisting apparatus engages the pipe to support the string before the slips in the spider are disengaged from the pipe. To reposition the hoisting apparatus relative to the pipe, the spider supported slips are again engaged before the hoisting apparatus releases the pipe load. Switching the load carrying function takes place each time a joint of pipe is added to, or removed from, the string. Time is saved in the slip management activity by using power actuating contrivances to lift and lower the slips relative to the bowl. The nature of pipe gripping contrivances in both the spider and the hoisting apparatus, for obvious safety reasons, are such that the slips cannot be released from the pipe until the pipe load is supported by another means.

The rotary table traditionally has a non-circular torque transmitting recess in the top just below the rig floor level with a round bore proceeding downward to accept a vertical pipe string. The drilling Kelly drive bushing normally fits in the rotary bore, engaging the recess, with all rotating parts generally flush with the rig floor. The rotary drilling art evolved with that configuration for obvious safety reasons. During the early years when wells were shallow, casing and tubing operations were simple and reasonably brief. The apparatus used to safely support casing or tubing strings were added atop the rotary drive and protruded upward several feet into the traditional rig crew work area. The wells are now deeper and the pipe string related activity has become more demanding and the spider related machinery is now mostly powered and bulky. The typical pipe string support spiders cannot be lowered into the rotary bore to be flush with the rig floor until the rotary drives are increased in size, or the spider assembly is consolidated and reduced in size, or both.

In the early years when pipe strings weighed less, some misalignment with the slips was not a matter of great concern. Additionally, the usually small well bore began just below the rig floor and little misalignment could occur. Today, many feet of pipe may be suspended in a large conductor pipe below the rotary and misalignment can be greater. Also, the very large pipe loads suspended by the slips invite damage to pipe surfaces. When well bore activities take place from floating assets the alignment of the rotary table axis may vary from the vertical even if the pipe has no such misalignment. The alignment matter requires attention.

The pipe manipulation processes described above have remained constant over many years but the pipe supporting machinery used frequently is improved. For example, U.S. Pat. No. 4,381,584 to Coyle, Sr. And U.S. Pat. No. 4,354,706 to Coyle, Sr. Provide for a dual string spider and/or elevator which cannot angularly adjust. The Coyle, Sr. Patents disclose slips which function to grip and support the pipe but they do not provide for angular adjustment in any plane or direction to accommodate angular change in the pipe centerline relative to the generally vertical centerline of the bowl. Misalignment between the pipe centerline and the general centerline of the gripping surfaces of the slips can damage the outer surface of the pipe string.

U.S. Pat. No. 5,335,756 to Penisson is restricted in it's radial movement of the slips and related gripping elements. Penisson does not provide a gripping assembly that can angularly align itself as an entire unit. In response to tilt of the pipe axis under load each gripping surface has to apply the unbalanced forces necessary to force alignment of independent assemblies. This may cause independent slip movement relative to pipe that can be especially destructive to pipe surfaces.

It is therefore an object of this invention to provide slip assemblies and related supporting surfaces that can move angularly as a unit relative to the bowl when supporting a string of pipe to allow the pipe axis to tilt about both horizontal axes relative to the generally vertical axis of the spider.

It is another object of this invention to provide apparatus to permit tilt of the pipe string axis relative to the supporting spider axis with machine components that will reside within the rotary table with the top of the spider generally flush with the rig floor.

It is yet another object of this invention to provide powered slip manipulating contrivances, for the spider, that reside in the bore of the rotary table when the slips are gripping pipe.

These and other objects, advantages, and features of this invention will be apparent to those skilled in the art from a consideration of this specification, including the attached claims and appended drawings.

SUMMARY OF THE INVENTION

A generally flush spider assembly includes pipe gripping slips, slip carriers, and at least some generally spherical bowl surfaces in the spider opening to engage the mating surfaces of the slip carriers. The spider resides within the opening of the rotary table and is rotationally secured by the non-circular upwardly opening drive recess of the rotary table. The slips are carried on the slip carriers by mating generally planar surfaces that are sloped downward and inward. The generally vertical gripping surfaces of the slips and the planar surfaces provide the common wedge shape for the slips. The slip carriers interposed between the slips and the bowl surfaces can tilt about both horizontal axes by continuous contact sliding movement between spherical surfaces on the carriers and mating surfaces of the bowl because all spherical surfaces have a common origin. With the slips gripping pipe, both carriers, both slips and the pipe can tilt about both horizontal axes as a composite unit. That prevents relative movement between the gripping surfaces on the slips and the gripped surface of the pipe when tilt does occur under load.

The rig floor work area is kept generally clear by providing a slip operating power cylinder for each cooperating slip and carrier that reside within the rotary table vertical bore. The slip operating cylinders are each primarily confined within the outline of the related cooperating slip and carrier to bear upon a surface of the spider to act against the slip when lifting the slip to clear pipe. There are two cylinders activated in unison. The cylinders are, optionally, synchronized by mechanically coupled liquid feed cylinders driven by a master cylinder to open and close the slips.

Optional configurations provide for accommodation of dual string pipe running. The apparatus is functionally the same but some parts are duplicated.

BRIEF DESCRIPTION OF DRAWINGS

In the drawings wherein like features have similar captions.

DETAILED DESCRIPTION OF DRAWINGS

Figure 1:
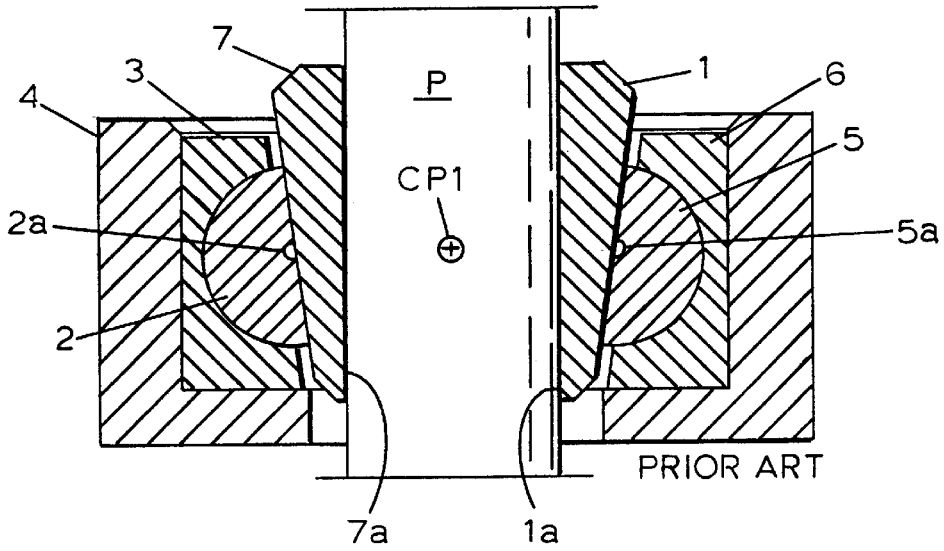
FIG. 1 is a side elevation, mostly cut away, of a prior art example.

In the drawings certain features well established in the art and not bearing upon points of novelty are omitted in the interest of descriptive clarity. Such omitted features may include weld lines, some threaded fasteners, threaded joints, fluid conduits, pins and the like.

In FIG. 1 (prior art) pipe P1 is gripped by slips 1 and 7 by surfaces 1*a* and 7*a*. These surfaces are normally serrated or toothed for better gripping the pipe. Slip carriers 2 and 5 can rotate within mating sockets in slip carriers 3 and 6 respectively. Their centers of rotation are 2*a* and 5*a* respectively. When the pipe tilts in the plane of the drawing it tilts about point CP1 and each slip has to slide relative to it's respective carrier. In the plane of the drawing, there are three axes of rotation, CP1, 2*a*, and 5*a*.

Figure 2:
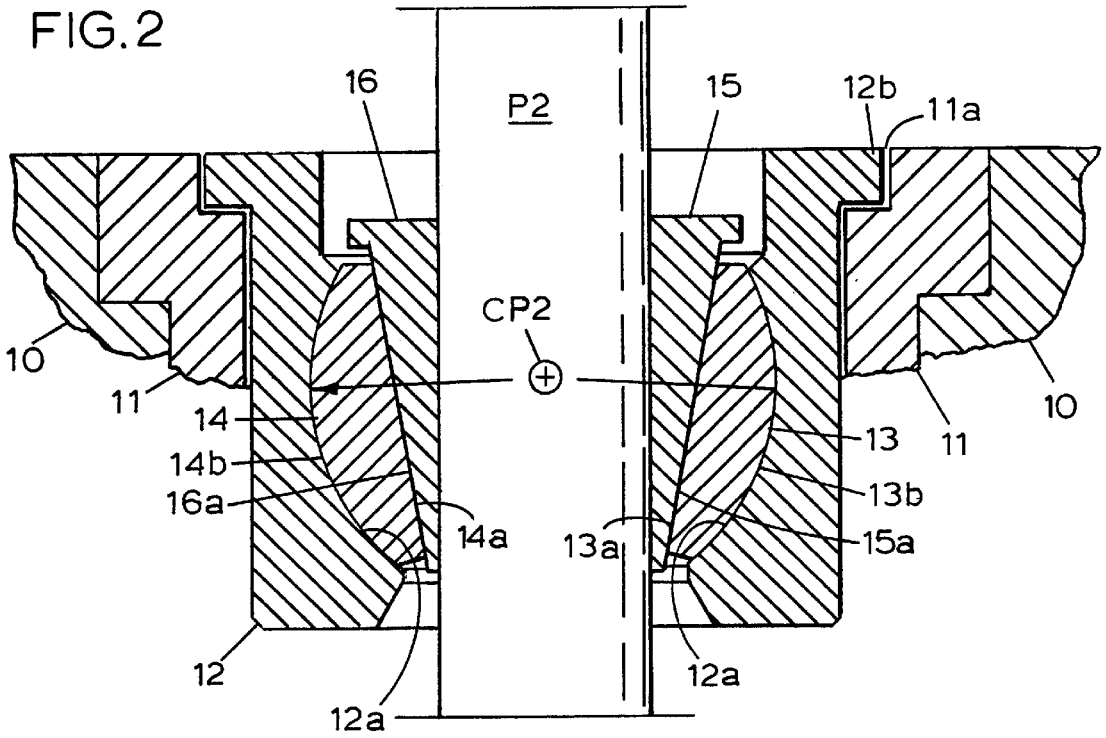
FIG. 2 is a side elevation, mostly cut away, of the preferred configuration of the present invention.

FIG. 2 shows the primary functions of the alignment features of the invention and it's relationship to common rig features. The rig will have work area rig floor 10 in which rotary table 11 is situated. The rotary table has spider drive non-circular features 11*a*, which differ somewhat is shape among the different rotary table sources. Spider 12 resides within the opening in the rotary table and does not intrude upon the work deck above the rotary. Slip manipulating gear is not shown in this figure in the interest of clarity but it is shown later in FIGS. 3 and 4. Pipe P2 is gripped by slips 15 and 16 which slide on inwardly and downwardly sloped surfaces 15*a* and 16*a* on surfaces 13*a* and 14*a* respectively on slip carriers 13 and 14. Spider 12 has internal spherical surfaces 12*a* to carry slip carriers 13 and 14 on their respective mating surfaces. Surface 12*a* is called the bowl and, in this case, may be interrupted in areas not intended to support slip carriers. All spherical surfaces have the common origin CP2 which lies on the longitudinal axis of the spider. A centered and vertical pipe normally has the centerline on the spider axis. Pipe P2 can tilt left or right in the plane of the drawing with all parts moved by the tilting motion sliding on the spherical surfaces and all movement will be about point CP2. That point can be on a line extending perpendicular to the drawing plane. Further, the pipe centerline can gimbal about point CP2 with the continuing pipe centerline defining a cone emanating in both vertical directions from the point CP2. Stated otherwise, the pipe can tilt about any horizontal line that passes through point CP2.

Figure 3:
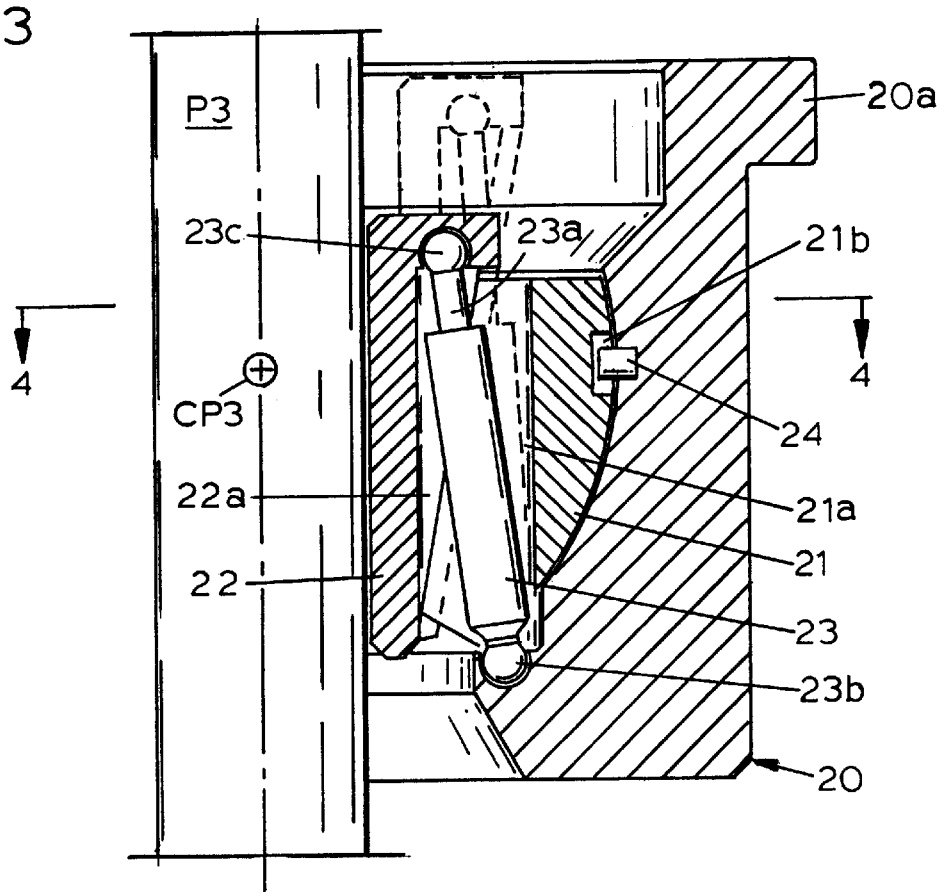
FIG. 3 is a side elevation, mostly cut away, showing one side of the apparatus of FIG. 2, somewhat enlarged, to present more ancillary details of the preferred embodiment.

FIG. 3 is similar to FIG. 2 but addresses the ancillary functions of slip handling features and spider-to-slip carrier rotational locking means. Spherical surfaces with focal point CP3 have been defined herein and now pin 24 is situated on a transverse plane containing CP3 and rests in slot 21*b* to prevent rotation of the slip carriers relative to the spider. Slip 33 has opening 22*a* and carrier 21 has cooperating opening 21*a* to accept power cylinder 23. Power cylinder 23, with no plumbing shown, acts between slip 22 and spider body 20 by way of terminal balls 23*b* and 23*c*. The cylinder can either pull or push. Spider non-circular upper flange 20*a* is shaped to fit the rotary table in use. Note that the slips rise (dashed line) to free pipe P3 but, preferably, do not extend above the top of the spider. The cylinder is oriented with rod 23*a* at the upper end but it can be reversed to clear the movable slip carrier. The cylinder 23 can act between slip carrier and cooperating slip to accomplish the functional purpose. That makes slip and carrier removable from the bowl as a unit. The cylinder still acts between spider and slip in terms of load stresses.

Figure 4:
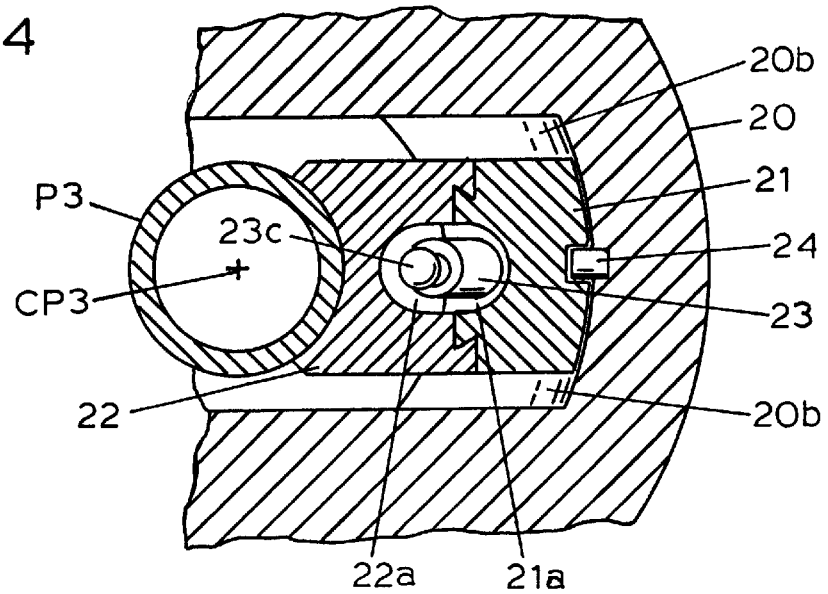
FIG. 4 is a view taken along line 4—4 of FIG. 3.

In FIG. 4 the spherical area 20*b* can be seen to extend enough to accept some tilting of the vertical axis of a gripped pipe P3. Pin 24 is on the same plane as CP3 and it needs little cooperating recess clearance.

Figure 5:
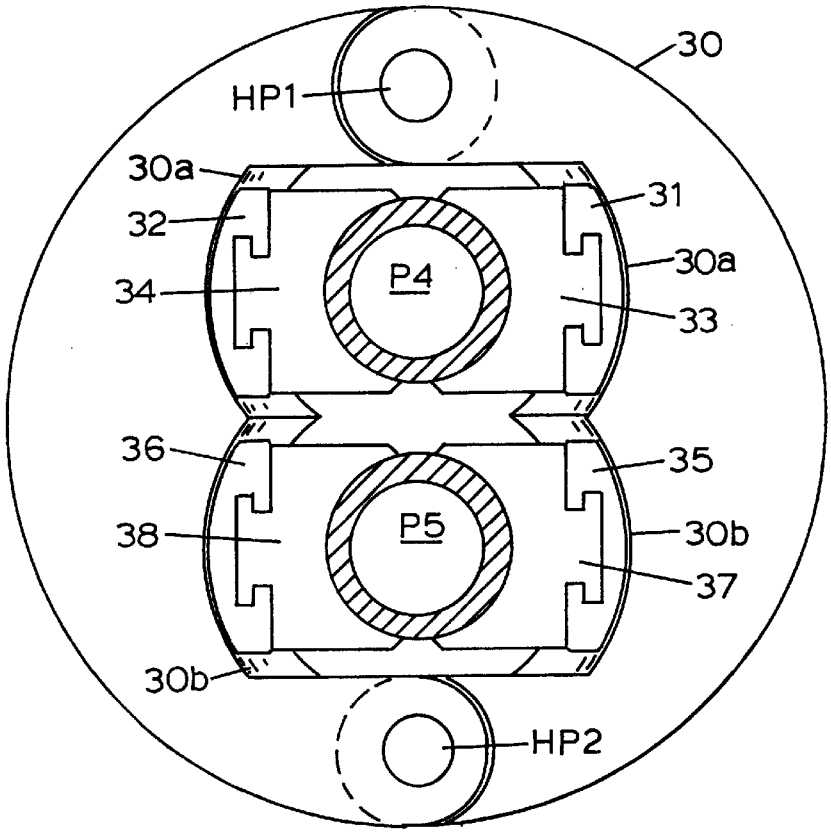
FIG. 5 is a top view of a dual string handling spider assembly from the aspect of FIG. 3.

The interlocking tongue and groove arrangement between slips and slip carriers are shown as dovetailed in FIG. 4 and T-slot in FIG. 5. Such systems are well established in the art and designers choices are usually related to manufacturers convenience in view of the environment of use.

FIG. 5 is a top view of a dual string handling spider that is similar to the apparatus of FIG. 3. This figure shows the optional assembly opening feature not shown on prior descriptions herein but commonly used. Spider body 30 is comprised of a plurality of segments. In this case it has two halves, that can be identical, with hinge links interdigited and secured by hinge pins HP1 and HP2. Either pin can be removed to allow the body to hinge open about the other pin. Body 30 has spherical surfaces 30*a* and 30*b* generated about a point on a line that coincides with the centerlines of gripped pipes P4 and P5 respectively. Slip carriers 31 and 32 carry slips 33 and 34 respectively. Bowl surfaces 30*b* support carriers 35 and 36 which carry slips 37 and 38 respectively. Excepting the dual string arrangement, this spider assembly is identical to that of FIG. 3. By designers choice, the spider halves may be divided and hinged on a horizontal line, of FIG. 5, to retain a full set of related slips and slip carriers in each half. For single string operations, the body can be comprised of three, rather than two segments, with two hingedly connected and two removably pinned together. Ideally, one slip and carrier assembly as shown in FIG. 4 would occupy each such segment.

Figure 6:
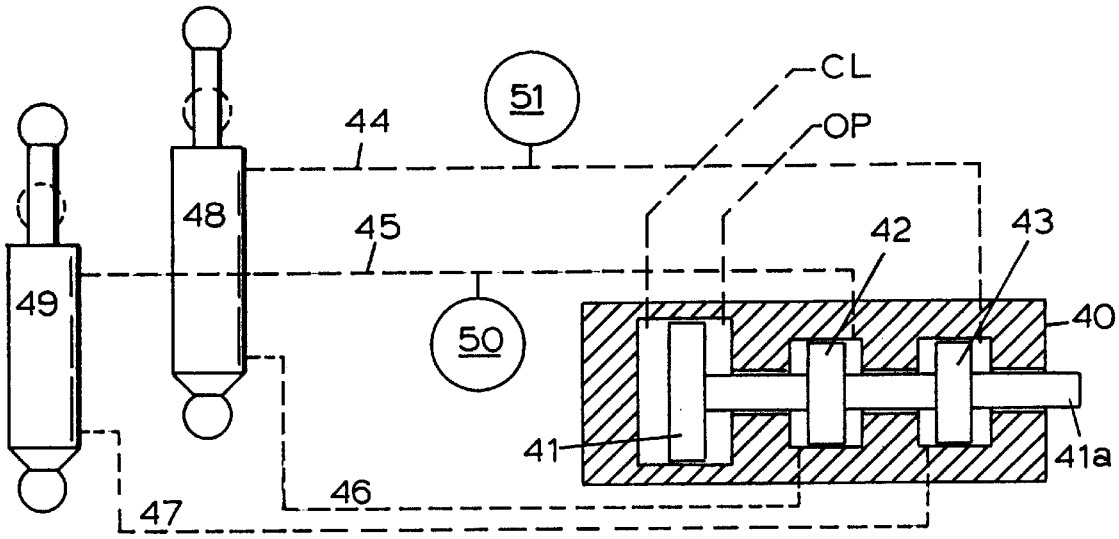
FIG. 6 is a schematic of the hydraulic synchronization control system for manipulation of the slips of FIG. 3.

FIG. 6 is a schematic of the synchronizing portion of the slip handling hydraulic cylinders of FIG. 3. Housing 40 carries power piston 41 which drives pump pistons 42 and 43 on rod 41*a* with hydraulic power delivered through lines CL for closing and OP for opening the slips. Lines 44 and 45 deliver fluid to the rod ends of cylinders 48 and 49 respectively. These are the slip closing pressure sources. Lines 46 and 47 deliver hydraulic fluid to cylinders 48 and 49 respectively on the slip opening side. Hydraulic accumulators 50 and 51 are gas charged and cause their related closed circuits to stand at a positive pressure.

Cylinder synchronization, once established, is maintained by the cooperating cylinders associated with lines 46 and 47 respectively. System elasticity, both liquid and solid, is managed by the accumulators.

It will be understood that certain features and sub-combinations are of utility and may be employed without reference to other features and sub-combinations. This is contemplated by and is within the scope of the claims.

As many possible embodiments may be made of the orienting motor of this invention without departing from the scope thereof, it is to be understood that all matter herein set forth or shown in the accompanying drawings is to be interpreted and not in a limiting sense.

What is claimed is:

1. A spider apparatus for enclosure within a rotary table opening for angularly adapting to accept and support misaligned pipe in one or more tubing strings, the apparatus comprising:

a) a housing having a longitudinal opening extending therethrough, to accept at least one tubing string, and forming opposing downwardly curved surfaces, said housing adapted to be received within the opening of said rotary table;

b) a plurality of slip carriers having correspondingly contoured exterior surfaces in rotational engagement with said opposing downwardly curved surfaces of the housing for angularly adapting to misaligned tubing strings, and having downwardly inclined interior surfaces;

c) a plurality of slips each having a correspondingly downwardly inclined exterior surface in sliding engagement with a slip carrier, and having longitudinal internal surfaces comprising gripping means for engaging the surface of tubing; and d) opposed longitudinal openings in said slips and slip carriers to provide space within each cooperating slip and slip carrier to accept a longitudinally situated power cylinder arranged to provide longitudinal opening and closing movement of each slip relative to its associated slip carrier.

2. The apparatus of claim 1 wherein fluid metering means is arranged to provide each said power cylinder with the same amount of actuating fluid, when moving in at least one direction, to synchronize the movement of cooperating slips.

3. A pipe string support spider apparatus for use in well drilling to rest in a rotary table opening to support a drill string suspended in said well, the apparatus comprising:

a) a body, with at least one upwardly opening, generally spherical concave surface with the point of origin of said surface located on a vertical axis, said body adapted to be received within the opening of said rotary table;

b) at least two slip carriers each with a surface situated to engage and slideably mate with said spherical surface, and having a downwardly converging opposed surface that crosses an extension of said vertical axis at about the same location; and c) at least two slips each with surfaces arranged to slideably mate with and engage said downwardly converging surfaces and provide generally vertical, opposed, pipe gripping surfaces, and at least one power cylinder provided for each said slip to move said slip toward and away from said vertical axis;

whereby downwardly directed force applied to said gripping surfaces provides proportional lateral movement and lateral forces to consolidate the assembly of pipe, slips, and carriers that can tilt about any horizontal axis that passes through said point.

4. The apparatus of claim 3 wherein each said cylinder is served with fluid flow equalizing means to assure that all said slips are provided with equal lifting movement.

5. A spider apparatus for enclosure within a rotary table opening for angularly adapting to accept and support misaligned pipe in one or more tubing strings, the apparatus comprising:

a) a housing having a longitudinal opening extending therethrough, with a vertical centerline to accept at least one tubing string, and forming opposing downwardly curved surfaces describing a sphere with a focal point on said vertical centerline, said housing adapted to be received within said rotary table opening;

b) a plurality of slip carriers each having a correspondingly contoured exterior surface in rotational engagement with said opposing downwardly curved surface of the housing for angularly adapting to misaligned tubing strings, and having downwardly inclined interior surfaces; and c) a plurality of slips each having a correspondingly downwardly inclined exterior surface in sliding engagement with said downwardly inclined interior surface of each corresponding slip carrier, and having longitudinal internal surfaces comprising gripping means for engaging the surface of tubing;

d) opposed longitudinal openings within each paired slip and slip carrier to accept a longitudinally situated power cylinder arranged to provide longitudinal opening and closing movement of each slip relative to its associated slip carrier.

6. The apparatus of claim 5 wherein fluid metering means is arranged to provide each said power cylinder with the same amount of actuating fluid, when moving in at least one direction, to synchronize the movement of cooperating slips.

7. A pipe string support spider apparatus for use in well drilling to rest in a rotary table opening to support a drill string suspended in said well, the apparatus comprising:

a) a body, with an upwardly opening, generally spherical concave surface with the point of origin of said surface located on a generally central vertical axis, said body arranged to be received within the said rotary table opening;

b) at least two slip carriers with surfaces situated to engage and slideably mate with said spherical surface, and having downwardly converging opposed surfaces that cross an extension of said axis at about the same location;

c) at least two slips with surfaces arranged to slideably mate with and engage said downwardly converging surfaces and provide generally vertical, opposed, pipe gripping surfaces; and d) an upper non-circular drive plate arranged to mate with a rotary table non-circular drive recess with all other elements of the apparatus below said drive plate, whereby downwardly directed force applied to said gripping surfaces provides proportional lateral movement and lateral forces to consolidate the assembly of pipe, slips, and carriers that can tilt about any horizontal axis that passes through said point.

8. A pipe string support spider apparatus for use in well drilling to rest in a rotary table opening to support a drill string suspended in said well, the apparatus comprising:

a) a body, with an upwardly opening, generally spherical concave surface with the point of origin of said surface located on a generally central vertical axis, said body arranged to be received within said rotary table opening;

b) at least two slip carriers with surfaces situated to engage and slideably mate with said spherical surface, and having downwardly converging opposed surfaces that cross an extension of said axis at about the same location;

c) at least two slips with surfaces arranged to slideably mate with and engage said downwardly converging surfaces and provide generally vertical, opposed, pipe gripping surfaces; and d) at least one power cylinder provided for each said slip to move said slip toward and away from said vertical axis.

9. The apparatus of claim 8 wherein each said cylinder is served with fluid flow equalizing means to assure that all said slips are provided with equal lifting movement.

* * * * *